United States Patent [19]

Verslycken

[11] Patent Number: 4,803,482

[45] Date of Patent: Feb. 7, 1989

[54] EXIT CONTROL AND SURVEILLANCE SYSTEM

[76] Inventor: Alain Verslycken, 3, rue du Val Saint Martin, 77260 La Ferté-sous-Jouarre, France

[21] Appl. No.: 15,051

[22] Filed: Feb. 17, 1987

[30] Foreign Application Priority Data

Feb. 19, 1986 [FR] France ..... 86 02359

[51] Int. Cl.[4] ..... G08B 25/00; G08B 13/08

[52] U.S. Cl. ..... 340/825.31; 340/528; 340/541; 292/92; 70/92; 70/271; 49/30; 49/32

[58] Field of Search ..... 340/528, 527, 540–542, 340/545, 825.31, 825.32, 505, 543, 309.15, 825.06; 70/91, 92, 262–264, 267–271, 274; 292/21, 92, DIG. 65; 49/29–32, 15; 358/108; 361/172; 52/106

[56] References Cited

U.S. PATENT DOCUMENTS 3,950,678 4/1976 Brewer ..... 70/271
4,631,528 12/1986 Handel et al. ..... 340/545
4,652,862 3/1987 Verslycken ..... 70/92

FOREIGN PATENT DOCUMENTS 0065418 11/1982 European Pat. Off. ..... 70/92

*Primary Examiner*—John W. Caldwell, Sr.
*Assistant Examiner*—Edwin C. Holloway, III
*Attorney, Agent, or Firm*—Laff, Whitesel, Conte & Saret

[57] ABSTRACT

In the system, exits are provided with opening bars and locks. The system has a central post and control boxes. Each control box is associated with an exit and is connected to the central post. Activation of an opening bar initiates the sending of information to the central post by the associated control box. This triggers a first delay To. During this delay, the opening of the exit can be stopped for a further delay Tc. The opening is allowed at the end of the first delay or at the end of the second delay. A third delay Tp can be triggered during the second delay Tc to allow the opening of the exit under question during the third delay Tp and to relock the exit under question at the end of the third delay Tp, by cancelling the effect of the second delay Tc. The system can also operate in the anti-intrusion mode. In particular, it can be used in stores or public establishments of medium area.

5 Claims, 11 Drawing Sheets

Figure 1:
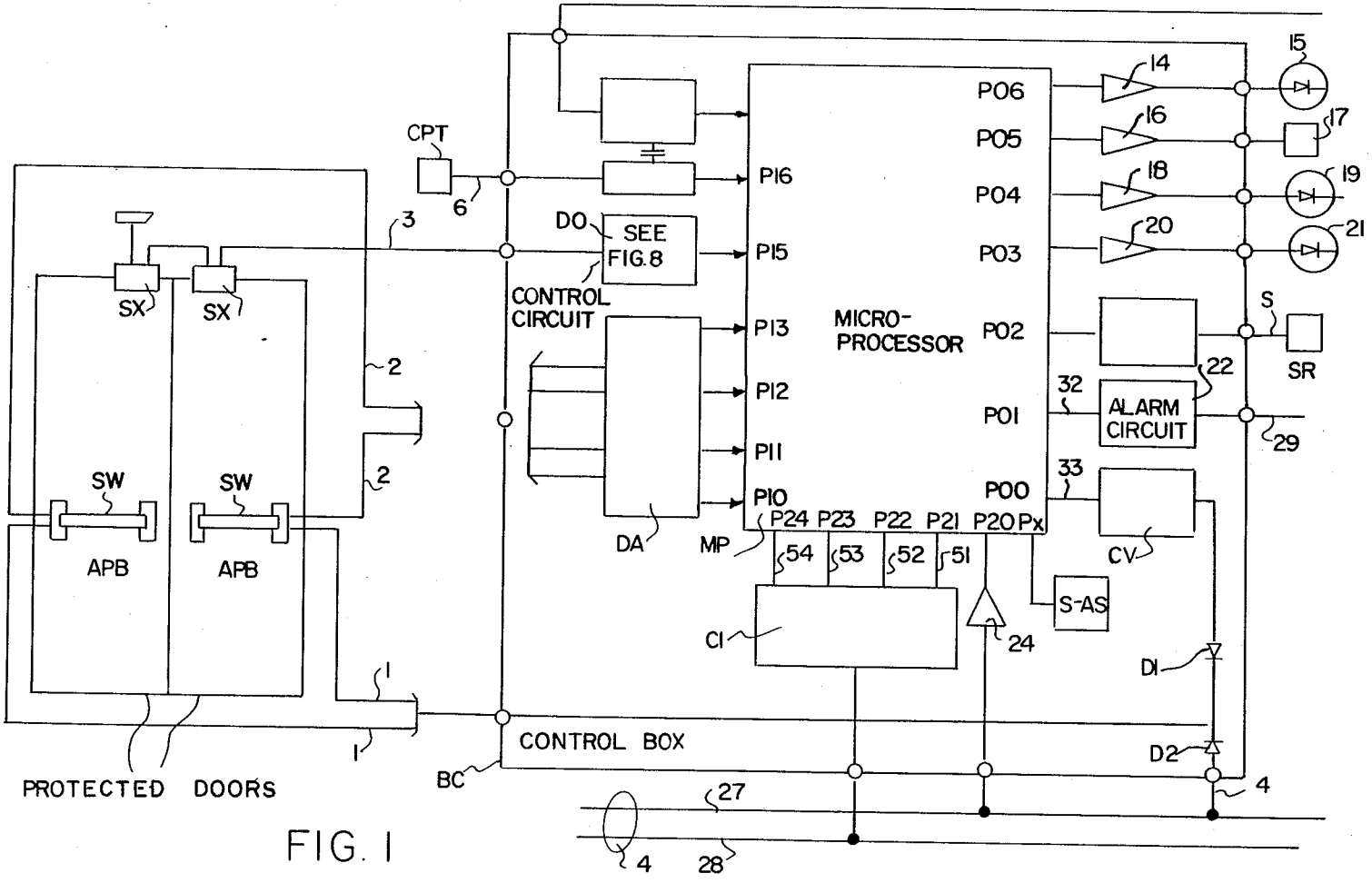

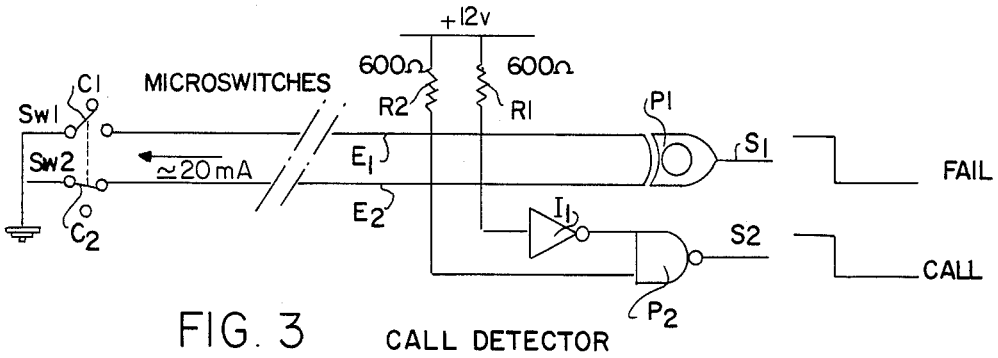
FIG. 3 CALL DETECTOR
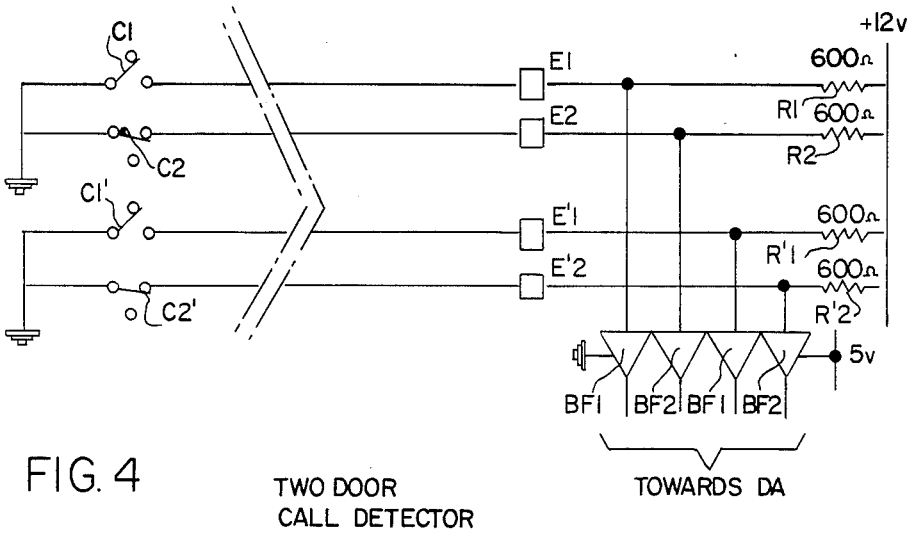
FIG. 4 TWO DOOR CALL DETECTOR
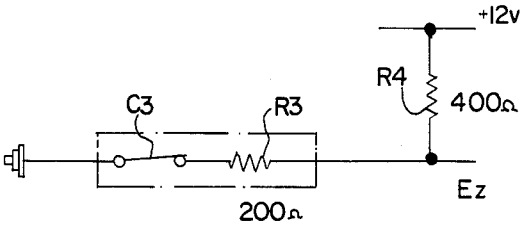
FIG. 5 OPENING SENSOR

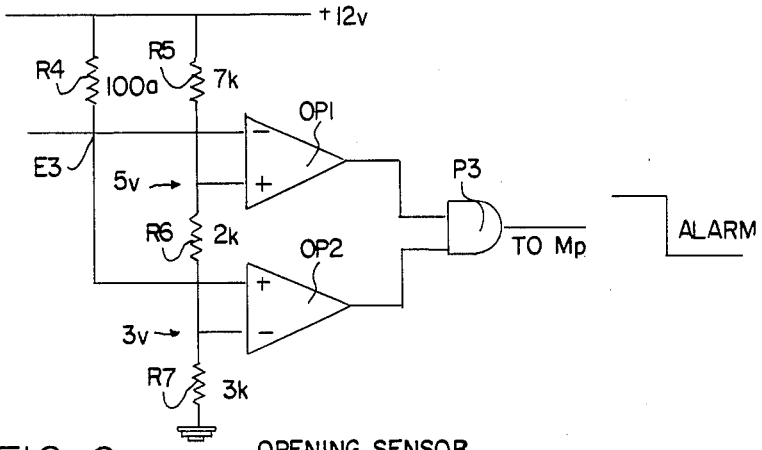
FIG. 6 OPENING SENSOR
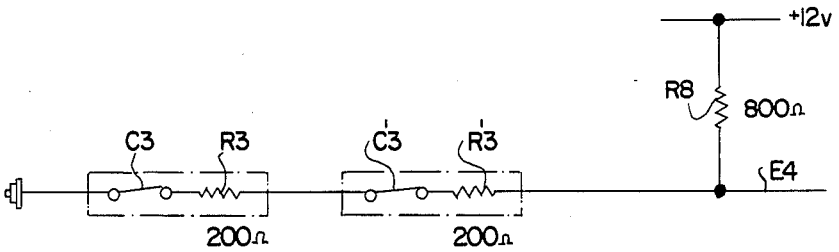
FIG. 7 OPENING SENSOR
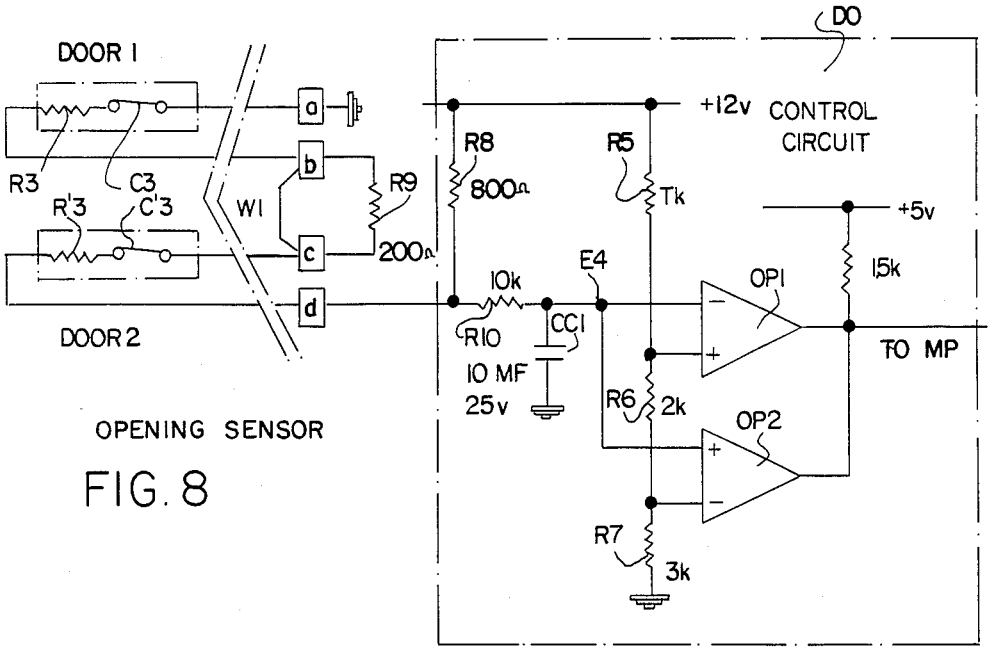
OPENING SENSOR
FIG. 8

LOCK CONTROL CIRCUIT

ALARM CIRCUIT 22

EXIT CONTROL AND SURVEILLANCE SYSTEM

The present invention relates control and surveillance system intended to be used in retail stores with average areas of the order of 2500m$^2$.

The safety exits of establishments open to the public are provided with opening levers which must unlock those exits when pushed by people, to provide a quick evacuation of the public in the case of an accident, such as a fire. In practice, to prevent these exits from being used fraudulently, either to introduce people into the store, or to take out merchandise, management had a tendency to prevent an opening of them, which was against the law; which explains the tendency to install surveillance and control systems for those exits. Among those systems, the simplest provides that the opening of a safety exit is accompanied by the triggering of an alarm which alerts a guard post; this system somewhat limits fraudulent use, but is not totally efficient.

Another system, which is described in document EP-A-0 156 752, also has a guard post and, for each safety exit, an unlocking lever. It also requires that an activating of the unlocking lever to open a safety exit causes the transmission of information to the guard post and the initialization of a first time delay "To" during which the guard, at the guard post, can prevent the opening of the exit during a second time delay "Tc". The opening of the exit is authorized at the end of the first time delay To or, in the case of intervention by the guard, at the end of the second time delay Tc. In particular, this system may be used in public establishments with very large surface areas, in which at least some of the exits are watched with video cameras.

One object of the present invention is the provision of an advanced system compared to the known systems, and in which the surveillance peronnel can take more initiative.

Another object of the inventon is the provision of a system capable of serving as an anti-intrusion alarm system when the space to be watched is closed to the public.

In accordance with a characteristic of the invention, a system is provided having a central post and control boxes. Each control box is associated with an exit and is connected to the central post, the activation of a panic bar initiating the transmission of information to the central post through the associated control box, which then triggers a first time delay To during which the opening of the said exit can be forbidden during a second time delay Tc. The opening of the exit is allowed at the end of the first delay or at the end of the second delay. A third delay Tp can be triggered during the second delay to authorize the opening of the exit during the third delay Tp and to relock the exit at the end of the third delay Tp by cancelling the effect of the second delay Tc.

In accordance with another characteristic, the central post has means to control the locking of doors to lock and keep the exits locked and switching means to activate the locking control means.

In accordance with another characteristic, the control links between the central post and the control boxes form a loop with drops to each control box.

In accordance with another characteristic, the opening detection signalling link between the control boxes and the central post is a single line having contact closures in series associated with the control boxes, each contact being closed when the corresponding exit has not been opened.

Figure 2:
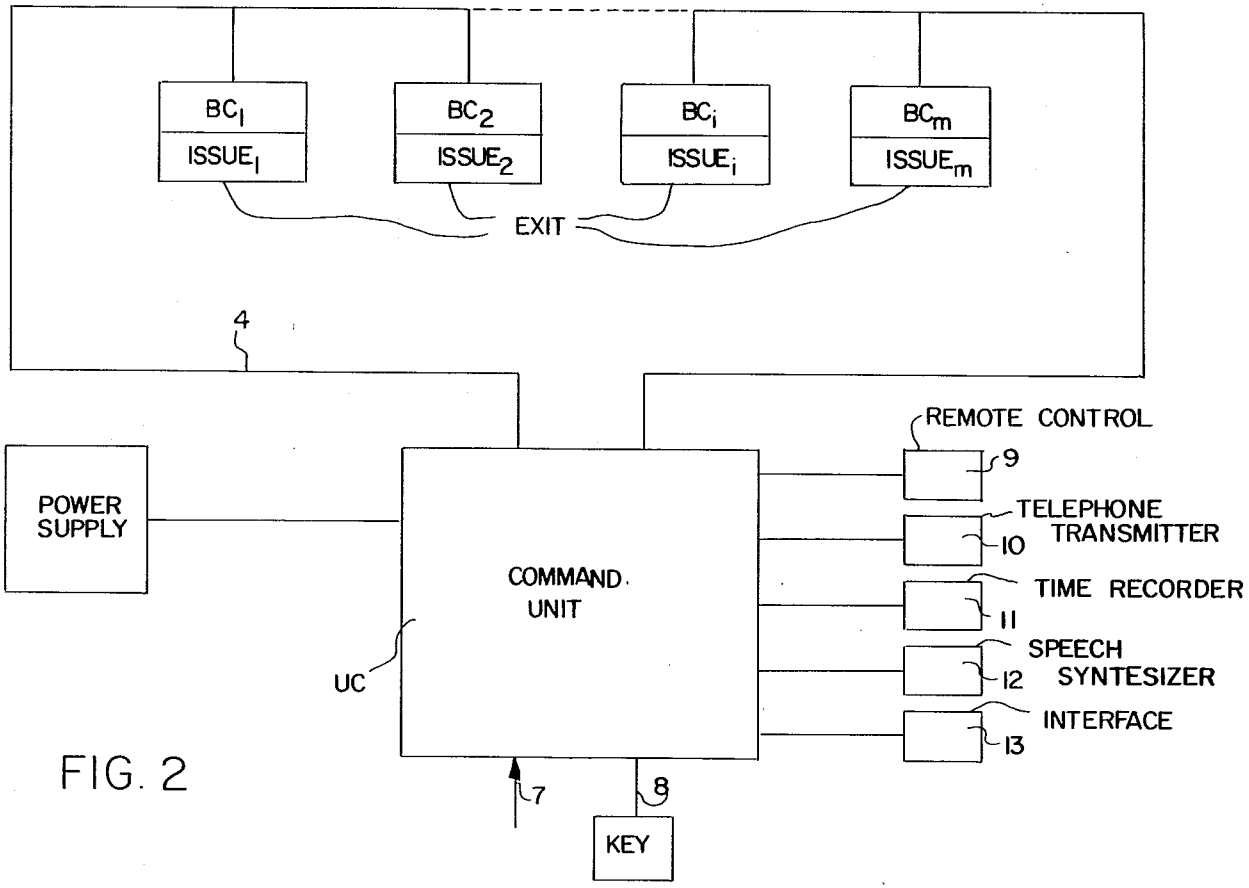
Figure 9:
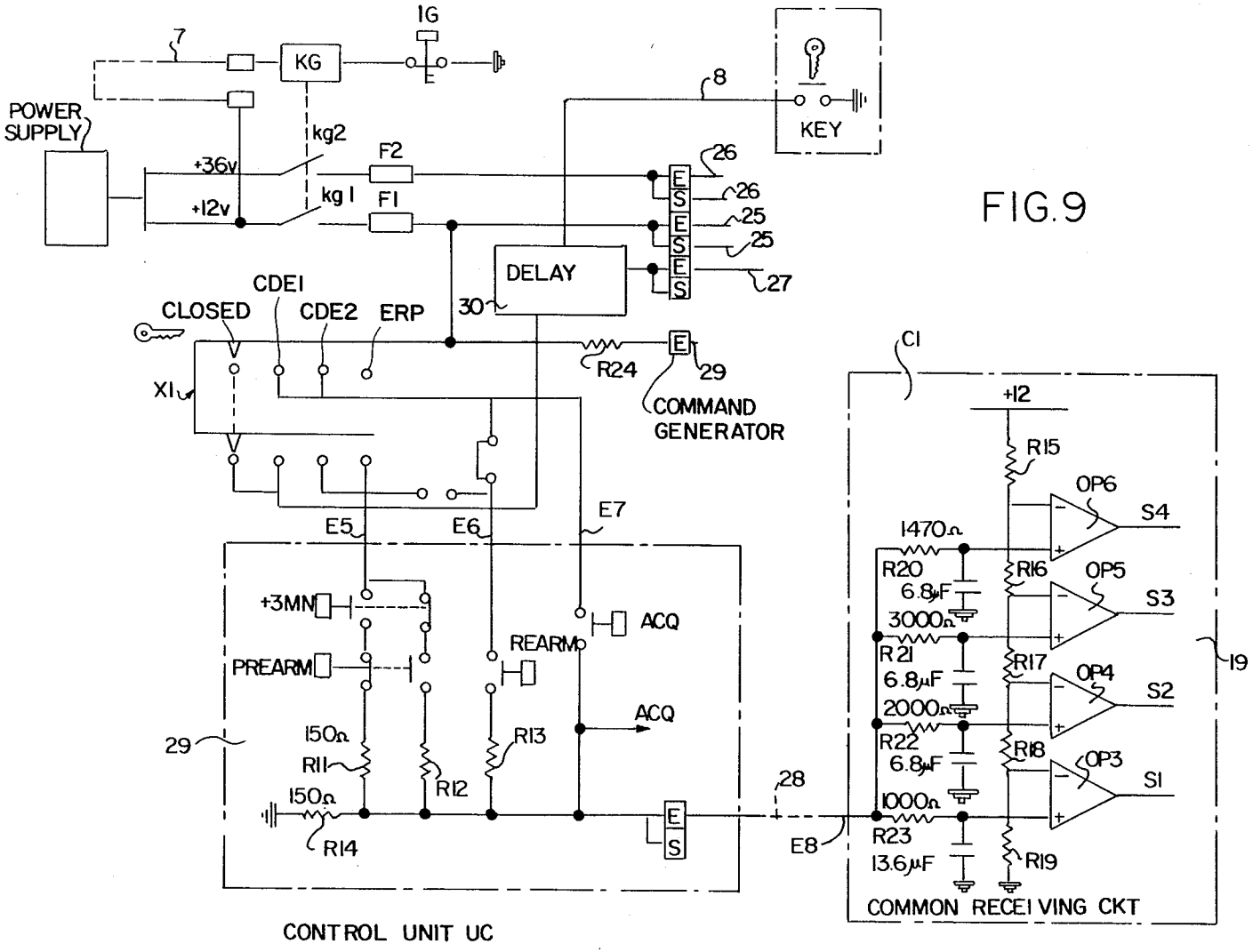
Figure 11:
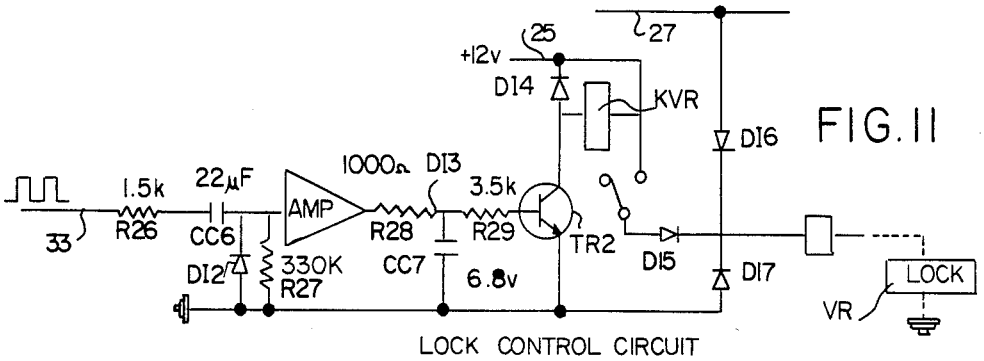
Figure 12:
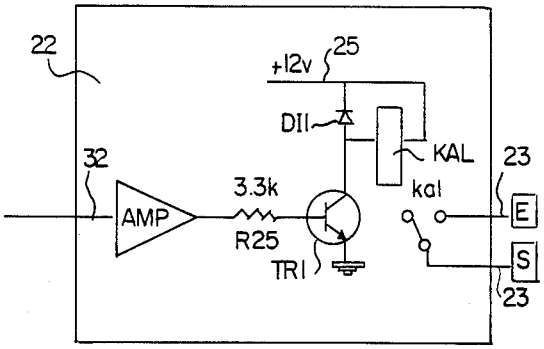
Figure 13:
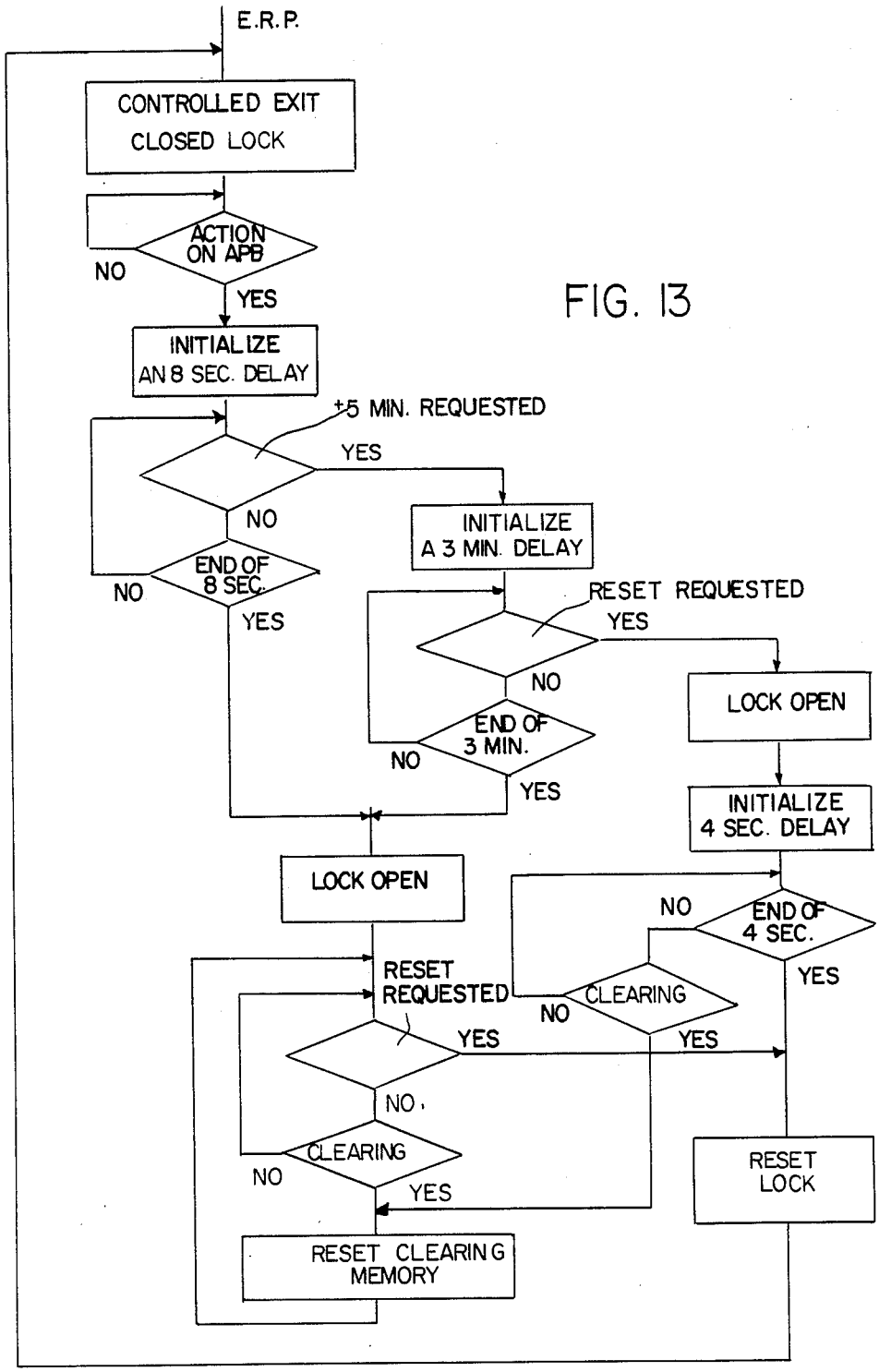
Figure 14:
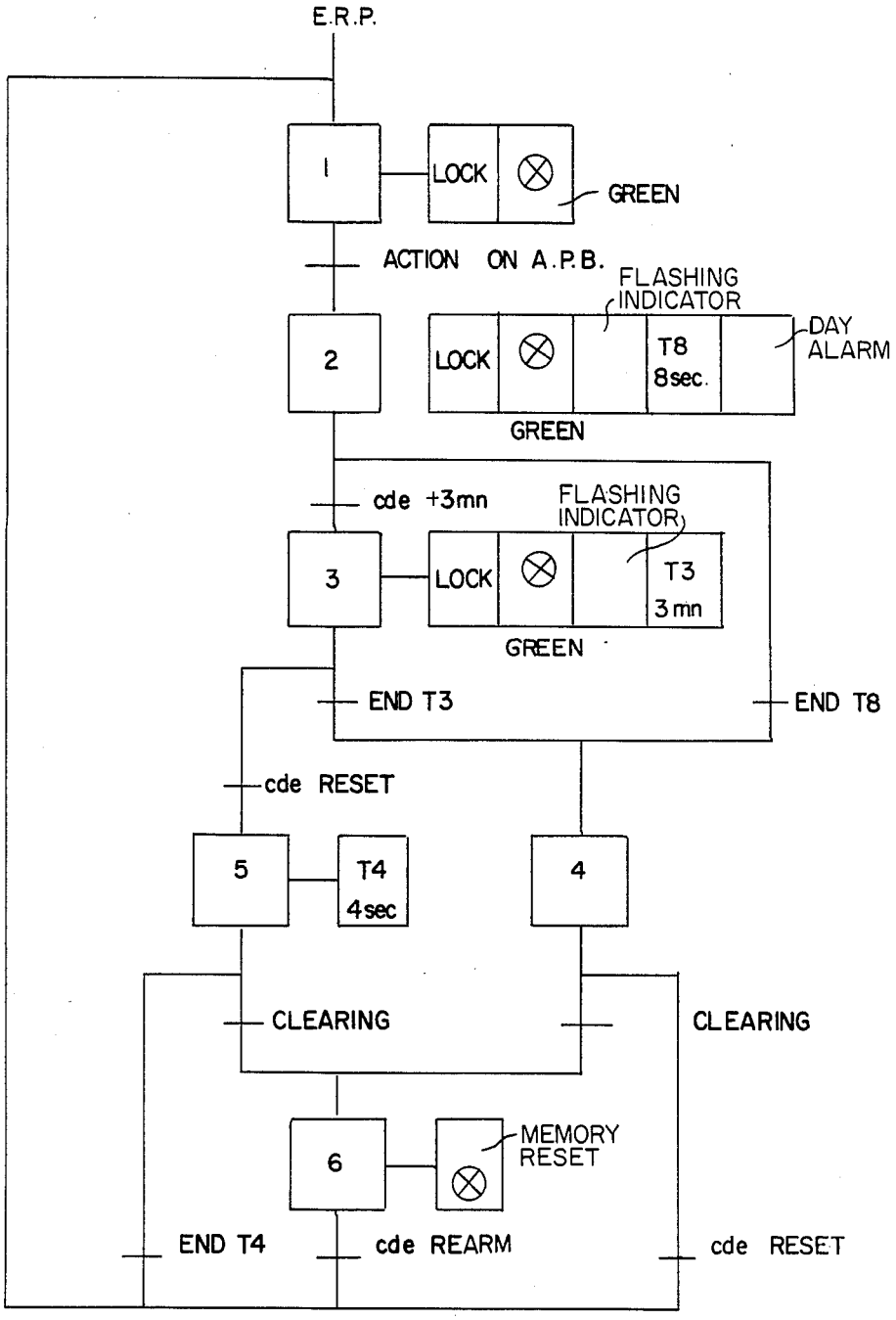
Figure 15:
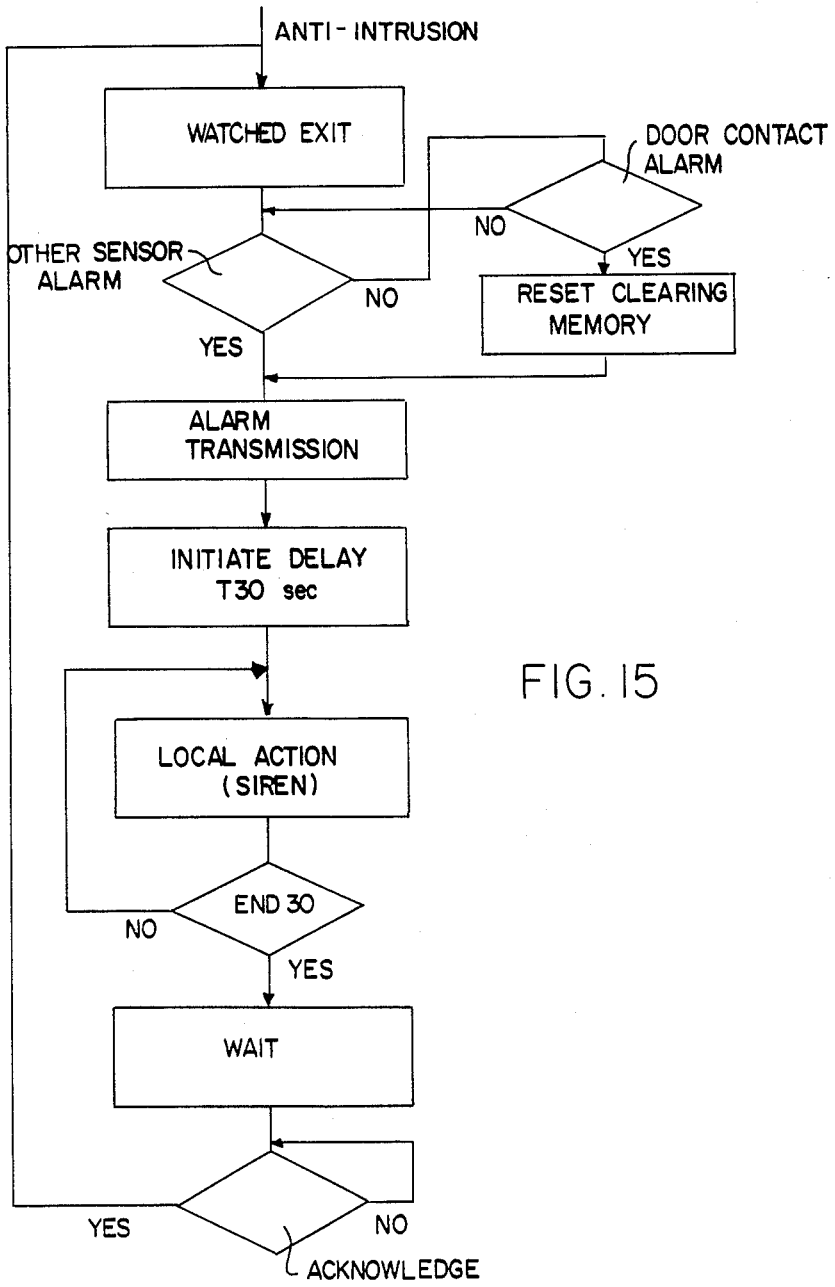
Figure 16:
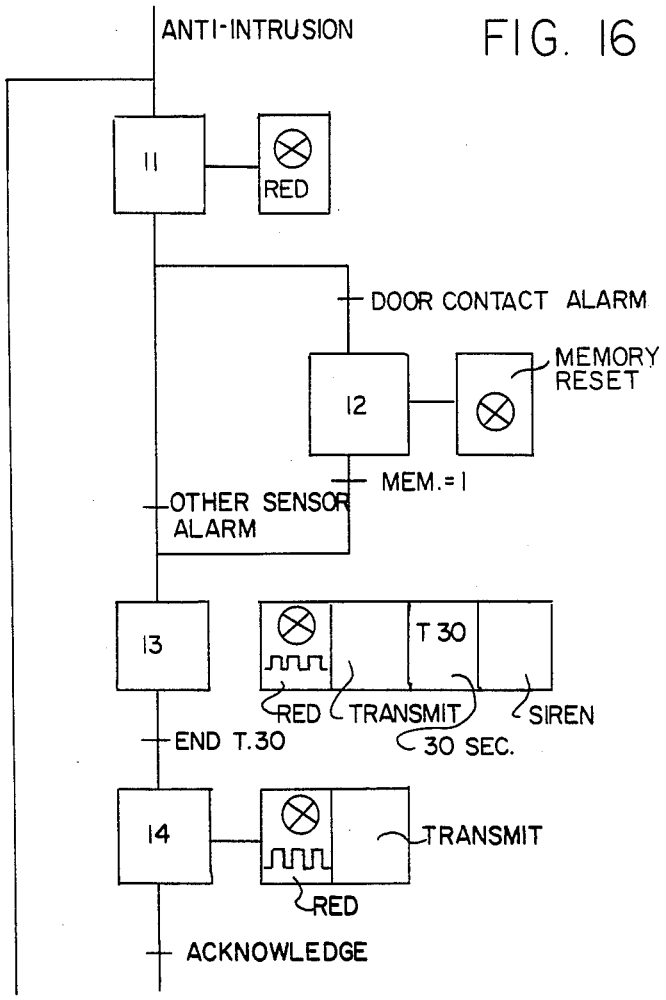

The above-mentioned characteristics of the invention as well as others will appear clearer upon reading the following description of an embodiment, the said description being made in relation to the attached drawings, among which:

FIG. 1 is a schematic illustrating the means which are part of the control and surveillance system in accordance with the invention and which are installed on and exit and in close proximity to it, FIG. 2 is a diagram of the control and surveillance system in accordance with the invention and, in particular, the block diagram of the central post of the system, FIG. 3 is a schematic of a call detector in accordance with the invention, FIG. 4 is a schematic of a variation of the detector of FIG. 3, FIG. 5 is the schematic of a known opening sensor, FIG. 6 is the schematic of an opening sensor in accordance with the invention, using the sensors shown in FIG. 5, FIG. 7 is a schematic illustrating a variation of the setup of sensors of FIG. 5, FIG. 8 is the schematic of an opening sensor in accordance with the invention, FIG. 9 is a schematic of the first part of the control circuit from the command unit of FIG. 2, FIG. 1O is a schematic of the second part of the control circuit from the command unit of FIG. 2, FIG. 11 is a schematic of the control circuit for the exit locks of FIG. 2, FIG. 12 is a schematic of an output circuit of the microcontroller of FIG. 1, FIG. 13 is a flow chart illustrating the operation of the system when it is in the OPEN state, FIG. 14 is a Grafcet diagram illustrating the operation of the system automation in relation to the flow chart of FIG. 13, FIG. 15 is a flow chart illustrating the operation of the system when it is in the CLOSED state, and FIG. 16 is a Grafcet diagram illustrating the operation of the automatic system in relation to the flow chart of FIG. 15.

FIG. 1 shows a double door (Dutch door) exit to be watched. Each door has an anti-panic bar APB, contacts SW which change state when a push is applied to the door in question, and a control box BC. The control box contains electrical and electronic circuits which have links 1 to the APB electro-magnetic bar locks, links 2 toward the contacts SW, a link 3 toward the opening sensor contacts SX and links 4 toward a command unit UC. Furthermore, an alarm (or a flasher) SIR and a volume sensor CPT are schematically represented and connected to the contol box by links 5 and 6 respectively. 0f course, a control box BC could also be associated with a single door exit.

FIG. 2 illustrates link 4 connecting the control boxes BCl to BCm to the command unit UC. It is apparent that link 4 forms a loop to which are connected the control boxes of exits 1 to m, the connections being made by drops.

In FIG. 2, we have also shown, connected to the command unit UC, a power supply circuit ALIM for supplying for example 12V dc, a line 7 carrying a fire detection signal, an electric key KEY contact link 8 and various auxiliary circuits, such as a remote control circuit 9, a telephone transmitter 10, a chronometer recorder 11, a speech synthesis circuit 12 and various interfaces 13.

Essentially, a control box BC (FIG. 1) has a microprocessor circuit MP, also referred to as microcontroller, input circuits one of which is a call detection processing circuit DA and an open detection processing circuit DO, output circuits one of which is a locking command circuit CV, an interface circuit for information exchange with loop 4 and various other input and output circuits, described below.

Thus in FIG. 1, we have also shown a power amplifier circuit 14 which output is connected to a light indicator 15, which changes for example to yellow when at least one of the panels has been opened, a power amplifier 16 whose output is connected to a buzzer 17, a power amplifier 18 whose output is connected to a light indicator 19 which changes to red when the area is out of bounds to the public (e.g. for the night), a power amplifier 20 whose output is connected to a light indicator 21 which changes to green when the area is open to the public, an alarm circuit 22 connected to a line 23 transmitting an alarm signal and an input amplifier 24 whose input is connected to link 4.

In FIG. 1, line 1 is connected, on one hand, to the output of circuit CV by a diode D1 and, on the other hand, to link 4 by a diode D2, the diodes D1 and D2 having their cathodes connected together.

An example of a basic call detector is shown in FIG. 3. It has an exclusive-OR gate P1 and a NAND gate P2. The E1 and D2 inputs of gate P1 are connected to the working contact of microswitch C1 and to the rest contact of microswitch C2 whose common contacts are connected to ground, respectively. The microswitches C1 and C2 are contained in an anti-panic bar APB and normally change state when the anti-panic bar is activated. One input of gate P2 is connected to input E1 through inverter I1 and its other input is connected directly to input E2. The E1 and E2 inputs are also connected to a +12V source of voltage by way of two resistors R1 and R2 each of 600 ohms, to allow approximately 20 mA to flow through the wires of the line. The outputs S1 and S2 of gates P1 and P2 are connected to the logic circuits DA contained in the control box BC.

The call detector of FIG. 3 allows the detection of either a push on the bar or a fault. In fact:

- when C1 is open and C2 is closed, the input E1 is high and input E2 is low. Thus the outputs S1 and S2 are both at the high level, which indicates that the bar is at the rest position,
- when C1 and C2 are open, E1 and D2 are at the high level. Thus, there is a fault; either there is disagreement between the microswitches, or the line is broken,
- when C1 is closed and C2 open, El goes to the low level and E2 goes to the high level. Thus, Sl is at the high level and S2 is at the low level, which indicates a push on the bar, that is a call, and
- when C1 and C2 are closed, E1 and E2 are both at the high level, S1 is at the low level and S2 is at the high level, which also indicates a fault, either a disagreement between the microswitches, or a short circuit on the line.

Thus, the call detector of FIG. 3 allows the detection of a push on the anti-panic bar in order to achieve the opening of the exit under surveillance, if the two microswitches have a simultaneous operation or the line which connects the bar to the box BC is neither cut, nor short-circuited.

In practice, the functions of gates P1 and P2 of inverter I1 are fulfilled by the logic functions of processing circuit DA to which the inputs E1 and E2 are connected.

Since the exit usually has two doors each having an anti-panic bar APB, two sets of micrcoswitches and two sets of electronic gates are provided. The output signals are connected, for example with OR gates.

The circuit of FIG. 4 shows an embodiment of a call detector for two-door (Dutch door) exits. It has two sets of microswitches C1, C2 nd C'1, C'2, a +12V supply, four resistors R1, R2 and R'1, R'2 of 600 ohms, with terminals E1, E2 and E'1, E'2. These terminals are connected to the inputs of four buffers or buffer amplifiers BF1, BF2, BF'1, BF'2 whose ouputs are connected to the respective inputs of logic circuit DA.

The operation of the detector of FIG. 4 is obviously deduced in the same manner as that of the detector of FIG. 3. Of course, the logic functions of the electronic gates can be activated in circuit DA, which can also process contact bounces such that no filtering is necessary.

FIG. 5 shows a preferred embodiment of an opening sensor in accordance with the invention.

We recall that a sensor to detect the opening of a panel is, in general, formed of a simple proximity switch which has a rest contact connected to ground and the other connected, on one hand, to a voltage source through a resistor and, on the other or moving contact hand, to a voltage comparator. Such an opening sensor does not allow the detection of an opening when the contact has been surreptitiously short circuited.

In the embodiment of FIG. 5, the opening sensor is formed of a contact C3 in series with a resistor R3, the common terminal of contact C3 being connected to ground and the other terminal of R3 being connected, on one hand, to a +12V voltage source by a resistor R4 and, on the other hand, to the E3 input of a voltage comparator. The resistor R3 and the contact C3 are mounted together in an inaccessible block contained in the sheathing of one of the panels. As an example, the resistor R3 has a value of 200 ohms and the resistor R4 has a value of 400 ohms.

When the contact C3 is closed at rest, the voltage at E3, which is common to R3 and R4, has a value of +4V. When the contact C3 is open, the voltage at E3 is +12V. When the line between E3 and C3 is cut, the voltage at E3 is 12V. When the sensor is short-circuited, the voltage at E3 is OV. It is apparent that it is sufficient to check if the voltage at E3 is between +3V and +5V to know if the contact is closed. Outside of this range, there is an event which is to analyze.

The circuit of FIG. 6 has a +12V source to which the resistor R4 is connected whose E3 terminal, connected to a senor, is also connected, on one hand, to the inverting input of an operational amplifier OP1 and on the other hand, to the non-inverting input of an operational amplifier OP2. A voltage divider comprised of three resistors in series, R5, R6 and R7 is connected between the +12V supply and ground. The resistors R5, R6 and R7 have values of 7 kilohms, 2 kilohms and 3 kilohms respectively. The common point to R5 and R6 is connected to the non-inverting input of OP1 while the common point of R6 and R7 is connected to the inverting input of OP2. The outputs of comparators OP1 and OP2 are connected to the two inputs of an AND gate P3 whose output is connected to circuit MP. It is apparent that the output of gate P3 is at the high level as long as the voltage at E3 is between +3V and 5V. When it goes to the low level, the circuit MP analyzes the change of state and, depending on its state, can trigger an alarm through circuit 22 of FIG. 1.

FIG. 7 is the schematic of an example of a preferred arrangement of an opening sensor, in accordance with the invention, for the case where the opening sensor is provided for an exit with two doors each having a sensor as in FIG. 5. Each of the two sensors C3, R3, and C'3, R'3 belong to a panel, are connected in series, the free terminal of C3 being at ground and the free terminal of R'3 being connected to a +12V supply by a resistor R8. The common point of E4 and R'3 and R8 is connected to a voltage comparator. In this connection example, R3=R'3=200 ohms and R8=800 ohms. When the sensors are closed and the line between R8 and R3' is in the normal state, the voltage at E4 is +4V. When the line between E4 and R'3 is open or if the sensors are open, the voltage at E4 is +12V. When one of the sensors is short circuited, the voltage at E4 is +2.4V. When the two sensors or the line are short-circuited, the voltage at E4 is OV.

FIG. 8 shows the complete schematic of the arrangement of an opening sensor in which the circuit of FIG. 7 is used. We have shown the hookup terminals a, b and c, d. The terminal a is connected to ground and to C3. The terminal b is connected to R3 and to terminal c, on one hand, by a strap W1 and, on the other hand, to a resistor R9. The terminal c is connected to contact C'3 and terminal d to resistance R'3, on one hand and, on the other, to the input of a voltage comparator. In this arrangement, the resistor R9 is short-circuited by W1 and serves no purpose. Furthermore, between the terminal d and the input terminal E4 of a comparator, which is identical to that of FIG. 6, a filter is provided which is comprised of a 10 kilohm resistor RlO in series and a 10 microfarads capacitor in parallel. This circuit can be shown to operate in the same manner as that of FIG. 7.

In the case where one would want this circuit to be used with a single door, the strap W1 between the terminals c and d should be removed, the 200 ohm resistor R9 entering into the circuit so that the operation of the comparator should not be affected.

The portion of the circuit of FIG. 8 which is to the right of terminal d is, actually, the DO circuit of FIG. 1.

Figure 10:
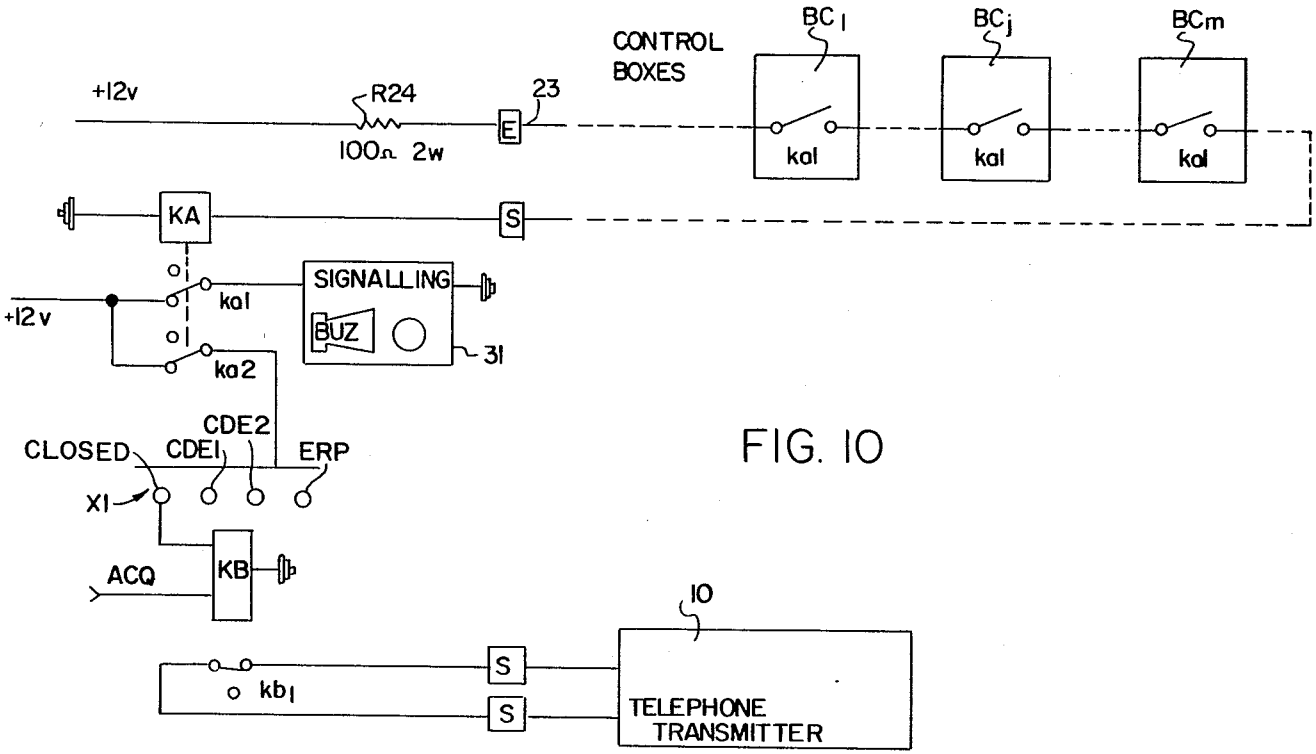

The control unit UC has a desk provided with a switch, pushbuttons and a set of circuits connected to the loop of link 4. The schematics of these circuits are shown in FIGS. 9 and 10. In practice, link 4 which is symbolically shown in FIG. 2, consists of a bundle of wires and transmits from the control unit UC to the control boxes BC, the supply of power for the +12V via wires 25, the secondary supply for the +24V via the wires 26, the ground potential OV, a state control, which will be described later, via wire 27 and various controls, such as the 3 min. delay control, the preset control, the reset control, the acknowledgement control via wire 28. Furthermore, line 23 permits reception of the alarm signals from the control boxes BC.

As mentioned in the preamble of the present description, the system of the invention is provided to operate in the "open" state, that is to protect the people when the establishment is open to the public, and in the "closed" state when the establishment is closed, to detect unwanted entry. For this purpose, the control unit UC (FIG. 9) has a four-position switch X1: "closed", "CDEl", "CDE2" and "open", which can be activated by the guard with a key.

One input of switch X1, FIG. 9 is connected by a fuse and a working contact Kgl to the 12V supply. The outputs of the switch are connected to inputs of a command generator 29 as well as to a timing circuit 30.

One input E5 of circuit 29 is connected to the state outputs OPEN and CDE2 of X1. Between the input E5 and line 28 two paths are provided: one comprising the working contact of a 3 min. button, the rest contact of a PRESET button and a resistor R11, and the other comprises a rest contact of the 3 min. button, a working contact of the PRESET button and a resistor R12. One input E6 is connected to the state outputs CDE1 and CDE2 of X1. A working contact of a RESET button and a resistor R13 is provided between E6 and line 28. An input E7 is connected to the state outputs CDE1 and CDE2 of X1. A working contact of an ACQ button is provided between E7 and line 28. In other respects, line 28 is connected to ground by a resistor R14, in circuit 29. The resistors R11, R12, R13, and R14 have the values 450, 150, 50 and 150 ohms respectively.

The delay circuit 30 is connected, firstly, to the ouputs CLOSED and CDEl of X1, secondly, to the KEY circuit through line 8 and, thirdly, to line 27 which transmits the CLOSED or OPEN information to the control box. In practice, the KEY circuit is used when the system is in the CLOSED state and the user enters the protected establishment.

In each control box BC (FIG. 10) a common receiving circuit is provided, as shown in FIG. 9 whose input is connected to line 28. The circuit C1 has four operational amplifiers OP3, OP4, OP5 and OP6, a voltage divider comprising, in series between the +12V and ground, the resistors R15, R16, R17, R18 and R19 of 400, 600, 500, 300 and 600 ohms respectively. The inverting inputs of the comparators OP3, OP4, OP5 and OP6 are connected to the common points of R15 and R16, R16 and R17, R17 and R18, R18 and R19 respectively. The non-inverting inputs of comparators OP3, OP4, OP5 and OP6 are respectively connected to line 28 by the resistors R20, R21, R22 and R23 whose values are 1470, 3600, 9600 and 11000 ohms respectively. They are also connected to ground by capacitors CC2, CC3, CC4 and CC5 whose values are 6.8, 6.8, 6.8 and 13.6 microfarads respectively. The outputs S1 and S4 of amplifiers OP3 to OP6 are connected to corresponding inputs of circuit MP in the control box BC, FIG. 1.

When there is no signal to transmit on line 28, that is when none of the +3 min, PRESET, RESET, ACQ buttons have been pressed, the voltage on the line is zero. Given the polarizations of the amplifiers OP3 to OP6, all the outputs Sl to S4 remain at the low level, the threshold of OP3 being +3V. When the +3 min. button is pressed, a voltage of +3.5V is applied to line 28 and only the Sl output goes to the high level, because the threshold of OP4 is 4.5V. When the PRESET button is pressed, a voltage of +5.5V is applied to line 28 and the outputs Sl and S2 go to the high level because the threshold of OP4 is +7V. When the RESET button is pressed, a voltage of +8V is applied to line 28 and the outputs Sl, S2 and S3 go to the high level, because the threshold of OP6 is +1OV. When the ACQ button is pressed, a voltage of +12V is applied to line 28 and the four outputs Sl to S4 go to the high state. Thus, the logical combinations of the output levels of Sl to S4 allow the decoding of the type of command. In practice, the outputs Sl to S4 are connected to circuit MP which carries out the decoding and decides which action to initiate.

It may be seen that an electrical locking prevents the transmission of both the +3 min. and the PRESET commands. A similar type of locking is not provided for the PRESET and ACQ buttons, since these buttons are in principle only available to a key holder, that is a manager of the establishment.

We must also note that the two-by-two combinations of the resistors R20 to R23 and the capacitors CC2 to CC5 establish, in addition to the filtering, increasing time constants such that whatever the command, the comparator whose threshold is just below the transmitted voltage toggles first. As a result, a false interpretation cannot occur in circuit MP which is programmed to scan from S4 towards Sl.

If line 28 is cut, no command is transmitted, the exit will be opened 8 seconds after the first action on the anti-panic bar at that exit.

In other respects, as shown in FIG. 9, it is clear that terminals E and S are provided for the lines 25, 26, 27 and 28 which means that these lines are looped back. Hence the cutting of a single line allows passage of commands on the other line.

The delay circuit 30 has the purpose of delaying the energizing of line 15 when the holder of key which allows the activation of switch Xl, puts it in the CLOSED position. This delay allows him to reach the exit door provided with the KEY circuit without triggering the alarm. Upon opening the establishment, the action on the KEY circuit triggers another delay in circuit 30 which results in cancelling the voltage on line 27 for the time necessary for the user to put switch Xl in the OPEN position.

The control unit UC, FIG. 9, also has a general switch IG, a general breaker KG, and a fire loop 7 between ground and +12V.

The relay KG is permanently energized, except if line 7 is open or if switch IG is activated. The relay KG has two contacts, one, Kg1, in series with fuse Fl, between the +12V supply and line 25, the other, Kg2, in series with fuse F2, between the +24V supply and line 26. A drop to alarm line 23 through resistor 24 is provided between fuse F1 and line 26.

In FIG. 10, resest contacts of relay KAL, each provided in a control box BC are connected in series on alarm line 23. Then line 23 is looped to a relay KA, located in the control unit, and ground. The relay KA is energized when all the contacts Kal are at rest and when relay KG (FIG. 9) is activated. In the opposite case, that is when it is necessary to trigger an alarm, it is deenergized.

The relay KA has a contact Kal, connected, on one hand, directly to the +12V supply and, on the other hand, to the supply circuit of a signalling circuit 31 comprising a siren and visual signals. It also has a contact Ka2 connected, on one hand, directly to the +12V supply and, on the other hand, to a terminal of switch X1, the CLOSED state of this terminal being connected to the energizing circuit of a bistable relay KB, to ground. The deenergizing circuit of relay KB is connected to input E7 of circuit 29, FIG. 9, through the ACQ button contact. The relay KB is normally energized as soon as switch X1 goes to the CLOSED state.

There is a rest contact arrangement in the telephone transmitter triggering circuit 10, also shown in FIG. 2. In the CLOSED state, when the relay KA falls back, the relay KB triggers the operation of the telephone transmitter 10.

In FIG. 9, the CDEl state allows the person responsible for the control unit UC to activate the delay 30 or to proceed with a release by pressing ACQ. Thus he can, among other things, bring the relay KB to its initial state.

FIG. 12 is the schematic of the alarm circuit 22 in the control box BC. A wire 32, normally energized, is connected, on one hand, to a corresponding output of circuit MP of the box and, on the other hand, to the input of a CMOS buffer amplifier AMP 1. The output of amplfier AMPl is connected by a 3.3. kilohm resistor to the base of switching transistor TRl whose emitter is connected to ground and collector is connected to line 25 through the winding of relay KAL, protected by a diode DI1. FIG. 12 also illustrates the working contact Kal of the relay shown on the alarm line 23.

During operation, when the circuit MP has received from the DO circuit information indicating an opening, it causes wire 32 to go to the low level, which causes relay KAL to release and open contact Kal, triggering the alarm by line 23.

The power circuits 14, 16, 18 and 20 are, preferably, of the same type as that shown in FIG. 9 for triggering a local alarm comprising a siren and for lighting up (or extinguishing) visual signals, which allow the identification of the exit which is the scene of an event.

FIG. 11 is the schematic of the lock or locks control circuit CV for an exit, this circuit being located in the exit's control box BC.

The circuit of FIG. 11 comprises a wire 33 connected to a corresponding terminal of circuit MP and on which are connected, in series, a 1.5 kilohm resistor R26 and a 22 nF capacitor CC6, the terminal of which that is not connected to R26 being connected, on one hand, to the input of an amplifier AMP2 and, on the other hand, to ground through a 330 kilohm resistor R27. A dc restoration diode DI2 is connected as a drop from resistor R27. The capacitor CC6 and the resistor R27 together form a differentiator. The output of CMOS amplifier AMP2 is connected to the base of switching transistor TR2 by a 100 ohm resistor R28 in series with a straight diode D13 and a 3.3 kilohm resistor. The common point of diode D13 and resistor R29 is connected to ground by a 33 microfarad tantalum capacitor CC7. The resistor R29 and the capacitor CC7 together make up a time constant polarization circuit. The emitter of transistor TR2 is at ground and its collector is connected to the +12V supply line through the coil of relay KVR, protected by diode DI4.

The relay KVR has a working contact kvr connected between the +12V line 25 and the anode of diode DI5. A diode DI6 is connected between line 27 and the cathode of diode DI5 while a diode DI7 is connected between ground and the cathode of diode DI5. The common point of the cathodes of the diodes DI5 to DI7 is tied to ground through the coil of one or more of the locking relays VR of the panels of the exit.

When the establishment is in the OPEN state, line 27 is not energized and wire 33 normally receives an attenuating rectangular signal from circuit MP, for example with a period of 100 ms and a duty cycle of unity. The differentiator CC6, R27 thus transmits a signal to amplifier AMP2 which periodically changes capacitor CC7. Thus, transistor TR2 remains energized and relay KVR remains active which energizes the locking relays VR through kvr. If the circuit MP ceases to apply the rectangular signal to wire 33, the relay KVR falls back unlocking the exit.

In other respects, when the establishment is in the OPEN state, line 27 energizes the lock relays VR directly through diode DI6. Diode DI7 is a blocking diode.

The circuit MP in each control box can, in reality, be a microcontroller of type 8051 of the MCS51 family manufactured by Intel. The internal structure of this microcontroller is well known to someone in the trade. The output ports of the microcontroller are, for example, connected in the following manner: POO to wire 33, POl to wire 32, P02 to a local alarm circuit with the siren SIR, P03 to circuit 20 energizing the green panel light 21 which lights up when the establshment is in the OPEN state, P04 to circuit 18 energizing the red panel light 19 which lights up when the establishment is in the CLOSED state, P05 to circuit 16 energizing the flasher 17, and P06 to circuit 14 energizing the orange panel light 15 of a crossing memory.

The input ports of microcontroller MP can be connected as follows: PlO to wire El, FIG. 3, of an anti-panic bar APB, Pll to wire E2 of the same bar, P12 to wire El of the other APB bar and P13 to wire E2 of the other bar, P15 to the common output of circuit DO, P16 to the output of another sensor CPT, P20 to the output of amplifier 24 connected to wire 27, P21 to wire Sl, FIG. 9, P22 to wire S2, P23 to wire S3 and P24 to wire S4. The conventional supply input Vcc of the microcontroller is connected to line 25 through a regulator REG. An oscillator or timer SM enables the microcontroller to generate the rectangular signal on wire 33.

FIG. 13 is a flow chart illustrating the operation of the system when the establishment is in the OPEN state. It is clear that a push on the anti-panic bar APB of an exit triggers the process. In the absence of a response by a watchman, the lock opens after 8 seconds allowing free movement of the anti-panic bar. However during 8 seconds, a watchman having made sure that there is no panic, can extend the delay to 3 min. by pressing the +3 min. button at the control unit UC desk. Without further action, the lock would open at the end of the 3 minutes. However, after having dealt with the request for exit, he can, during the 3 minutes preset the lock by pushing the PRESET button at the control unit desk. For security reasons, the lock then opens, then after 4 seconds, locks again. The watchman can also reset the lock by pressing the RESET button at the control unit desk. Each time that the exit has been opened, the microcontroller of the corresponding exit sends a signal to the associated crossing memory 15 which counts the openings. Note that the unlocking of an anti-panic bar does not necessarily imply the opening of the corresponding exit.

FIG. 14 is a normalized "GRAFCET" diagram illustrating the operation of the automatic system when the establishment is in the OPEN state.

FIG. 15 is a flow chart illustrating the operation of the system when the establishment is in the CLOSED state. It is clear that the alarm is triggered through the motion of the exit panel contacts. In that case, the crossing memory is loaded at the same time that the alarm is triggered. The alarm causes for a duration of 30 seconds, for example, local actions, such as the operation of a siren or a light flasher. The initial stat is only reestablished once a watchman has pressed on the clearing button ACQ.

FIG. 16 is a normalized "GRAFCET" diagram illustrating the functioning of the automatic system for the establishment in the CLOSED state.

In practice, it is also possible to supply the watchmen, who cannot be seen directly by the main watchman at the desk, with a remote transmitter, which has at least three pushbuttons. The first button is provided to achieve, in the control unit UC, the opening of switch IG which causes the general opening of exits. The second allows the closure of a contact, now shown in FIG. 9, which short circuits the working contact of the +3 min. button. The third allows the closure of a contact, not shown in FIG. 9, which short circuits the working contact of the PRESET button.

In one variation of the embodiment, line 23, FIG. 10, would be duplicated by a transmission line which would be connected to circuit S-AS of the control boxes BCl to BCm. Each circuit S-AS is connected to a terminal PX of circuit MP and serves to transmit in serial asynch a word which allows the identification of the control box BC which was activated, when line 23 does not allow the identification. The words sent by the boxes are received in the control unit which decodes them.

Of course, a receiver is provided in the control unit to open the contacts, in parallel with the buttons at the control unit desk. The transmission between transmitters and receivers is established through known electromagnetic means, avoiding the confusing of different remote commands.

I claim:

1. An exit survieillance control system for monitoring exits having opening request bars and locks, said system having a central command post from which said system is controlled and a plurality of control boxes, each of said control boxes being associated with an exit and being electrically connected to the control post, said system comprising means responsive to the operation of an opening request bar for initiating a transmission of information to via an associated control box, means responsive to said transmitted information for triggering a first delay period during which the exit in question can be forbidden to open during a second delay period, means for authorizing the opening of the exit in question at the end of either the first delay period or at the end of the second delay period, and means for providing a third delay period which can be triggered during the second delay period in order to authorize the opening of the exit in question during the third delay period by cancelling the effect of the second delay period.

2. A system in accordance with claim 1, characterized in that the central post comprises locking control means to lock and keep the exits locked and switching means to activate the locking control means.

3. A system in accordance with claim 1 or 2, further comprising link control means extending between the central command post and the control boxes, said link being a loop with drops extending from the loop to each control box.

4. A system in accordance with one of claims 1 or 2, further comprising opening detection signalling link means extending between the control boxes and the central command post, said signalling link being a simple line having in series working contacts which are individually associated with the respective control boxes, each contact being closed when the corresponding exit has not been opened.

5. A system in accordance with claim 4, wherein the opening detection signalling link is duplicated by a serial asynch line to which the control boxes are connected, each of said control boxes having an identification transmission circuit, said link being connected in a control unit of the identification circuit.

* * * * *